United States Patent [19]

Catallo et al.

[11] Patent Number: 4,586,222

[45] Date of Patent: May 6, 1986

[54] APPARATUS FOR TREATING AND STRAIGHTENING TUBULAR FABRIC

[76] Inventors: Frank Catallo; Donald Foreman, both of 103 Harbor Rd., Port Washington, N.Y. 11050-0105

[21] Appl. No.: 583,209

[22] Filed: Feb. 24, 1984

[51] Int. Cl.[4] ..... D06C 5/00

[52] U.S. Cl. ..... 26/51.3; 26/84

[58] Field of Search ..... 26/51.3, 51.4, 82, 83, 26/84

[56] References Cited

U.S. PATENT DOCUMENTS

| | | | |
|---|---|---|---|
| Re. 31,115 | 1/1983 | Catallo | 26/51.3 X |
| 1,387,155 | 8/1921 | Huber | 26/51.3 |
| 2,189,166 | 2/1940 | Cohn et al. | 26/83 X |
| 3,167,843 | 2/1965 | Robertson et al. | 26/51.4 |
| 3,401,584 | 9/1968 | Cohn et al. | 26/82 X |
| 3,740,805 | 6/1973 | Catallo | 26/51.3 X |
| 3,973,304 | 8/1976 | Catallo | 26/51.3 X |
| 4,112,532 | 9/1978 | Catallo | 26/51.3 X |

OTHER PUBLICATIONS

Mount Hope Data, "Application of Mount Hope Weft Stabilizer to Tenter Frames", MHTDB-WSTF Ingalls 10/76.

*Primary Examiner*—Robert R. Mackey

*Attorney, Agent, or Firm*—Pennie & Edmonds

[57] ABSTRACT

An apparatus and method for finishing a tubular fabric where the apparatus includes a fabric spreader for spreading the tubular fabric into a flattened tube. Edge drive means are provided to move the tube of fabric over a spreader past a fabric treating station. Control means are provided for maintaining and controlling a cross-line configuration of the fabric and/or width of the fabric. The control means comprises a pair of spaced opposed control rolls rotatable in opposite directions with the fabric passing over substantial arcs of each of the rolls. Speed control means are included for varying the speed of the control rolls with respect to the edge drive means to tension or bunch the fabric with respect to edge portions of the fabric driven by the edge drive means.

3 Claims, 4 Drawing Figures

APPARATUS FOR TREATING AND STRAIGHTENING TUBULAR FABRIC

FIELD OF THE INVENTION

This invention relates to a method and apparatus for treating a tubular fabric while maintaining cross-line control and/or maintaining control of width of the fabric. In particular, the invention relates to a fabric finishing machine and method for maintaining a cross-line configuration of a tubular knitted fabric produced on a circular knitting machine and/or maintaining width of the fabric where the fabric comprises a napped or lofty material and where it is desired that the fabric not have any sharp creases or flattened appearance after finishing.

BACKGROUND OF THE INVENTION

Circular knitted tubular fabrics usually require finishing on a calendar before the fabrics can be cut into pieces to be later sewn into garments. Conventional calenders, such as disclosed in U.S. Pat. No. 3,973,306, for treating such fabrics, usually comprise an internal spreader over which a tubular fabric is drawn by an edge drive means with steam being applied to the fabric while it is on the spreader or immediately thereafter. Such devices usually have a pair of chrome plated steel calendar rolls forming a nip extending in the vertical position. The tubular fabric in such instances leaves the spreader and steaming station and enters the nip formed between the two steel rolls where it is then pressed or calendered before it is batched at a batching station in either rolled or folded form prior to being transported to a cutting table.

The calendar rolls in such conventional apparatus also serve to control the center portion of the tubular fabric relative to its edge portions which are engaged by the edge drive means to move the fabric over the spreader and also serve to maintain the width of the fabric after it leaves the spreader. If the edge drive means engaging the edges of the tubular fabric moves faster or slower relative to the peripheral movement of the calendar rolls, then the cross-line or straightness of the fabric is effected. This can be a particular problem where the fabric to be finished may comprise a striped fabric. Control of cross-line or straightness of the fabric has been accomplished by varying the peripheral speeds of the calendar rolls with respect to the edge drive means such that the center of the tubular fabric may be bunched up or stretched with respect to the edges of the tubular fabric in order to maintain cross-line control. In order that the calendar rolls may exert sufficient pressure in the nip area on the fabric to maintain such cross-line control and/or to maintain width of the fabric after it leaves the spreader, a certain amount of pressure must be applied to the fabric so that it can be driven by or held back by the rolls. Such pressure presents a problem on certain types of fabrics where a flattened appearance or an edge crease is not desirable, for example napped fabrics as are used for sweat-shirts and lofty fabrics such as used in thermal material for underwear and such as used in sweater-type materials. In order to reduce sharpness of the crease occurring at the edges of the fabric, the nip pressure applied between calendar rolls in conventional treatment apparatus can be reduced, however it cannot be removed all together without losing cross-line control.

It is therefore an object of our invention to provide for an apparatus and method for finishing a tubular fabric which may maintain cross-line control of the fabric and/or maintain width to the fabric after it leaves a spreader without imparting objectionable crease to the tubular fabric or without imparting an objectionable flattened appearance to the fabric.

GENERAL DESCRIPTION OF THE INVENTION

Broadly a fabric finishing machine according to our invention comprises a fabric spreader for spreading a tubular fabric into a flattened tube. Edge drive means are provided to engage edges of the flattened tube in order to move the tube over the spreader and through the machine. A fabric treatment station is positioned downstream of the edge drive means in the direction of flow of fabric through the machine to provide a treatment to the fabric, as for example steam. The machine has a control means for maintaining and controlling cross-line configuration of the flattened tube of fabric and/or for maintaining width of the fabric as it passes through the machine which means comprises a pair of spaced opposed control rolls rotatable in opposite directions with the rolls being positioned downstream of the fabric treatment station with respect to the passage of the fabric through the machine. The rolls are arranged such that the tubular fabric will pass over and contact a substantial arc of the periphery of each roll. Speed control means for varying the speed of rotation of the control rolls with respect to the speed of the edge drive means is provided such that lateral portions of the tubular fabric may be selectively tensioned or bunched with respect to the edge portions of the tubular fabric to maintain cross-line control of the fabric and to assure there will be no bunching of the fabric between the spreader and control rolls when used to maintain width of the fabric.

Preferably the control rolls are positioned with their axes of rotation located in a horizontal plane such that the tubular fabric coming from the fabric treatment station will contact one roll along a tangent thereto and extend over an arc of the roll to then pass to the second roll along a tangent thereto to extend over an arc of the second roll such that the fabric takes the general form of an S-shape passing over the two rolls. One or both of the rolls may have a roughened surface in order to increase the friction between the tubular fabric and the rolls.

The machine may include nip adjustment means for varying the spacing between the control rolls such that the length of the arc of each roll over which the fabric extends can be varied. In instances where it is not a requirement to preserve the loftiness of the fabric, the rolls may be moved towards each other to impart a nip pressure on the fabric such that the rolls will then act as conventional calendar rolls.

It further may be desirable in certain fabric treatments that one or more of the control rolls be heated.

The method of operation of a machine as described involves the steps of pulling the fabric over a spreader, moving the fabric past a steaming means, extending the fabric over a substantial peripheral arc of first one roll of the pair of control rolls and then over a substantial peripheral arc of the other roll of the pair of control rolls, varying the peripheral speed of the rolls with respect to the speed of the edge drive means to bunch or tension lateral portions of the tubular fabric with respect to edge portions and delivering the fabric to a batching station. Further cross-line control can be achieved by varying the peripheral speed of the rolls with respect to the speed of the edge drive means to selectively bunch or tension lateral portions of the tubular fabric with respect to edge portions while width control can be achieved by varying the peripheral speed of the rolls with respect to the edge drive to assure no bunching will occur between the spreader and the rolls.

DESCRIPTION OF THE PREFERRED EMBODIMENT

Figure 1:
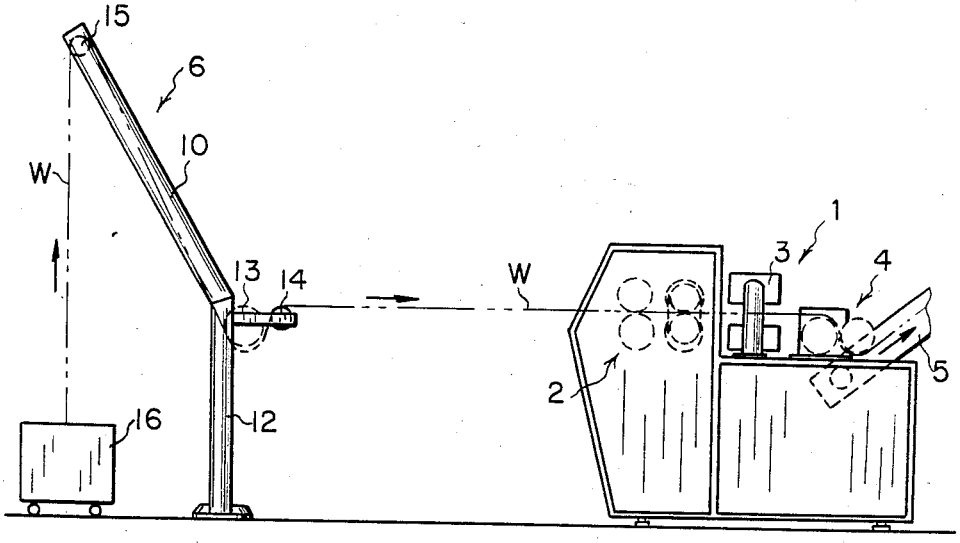
FIG. 1 is a diagrammatical side elevational view of a machine constructed according to the invention.
Figure 2:
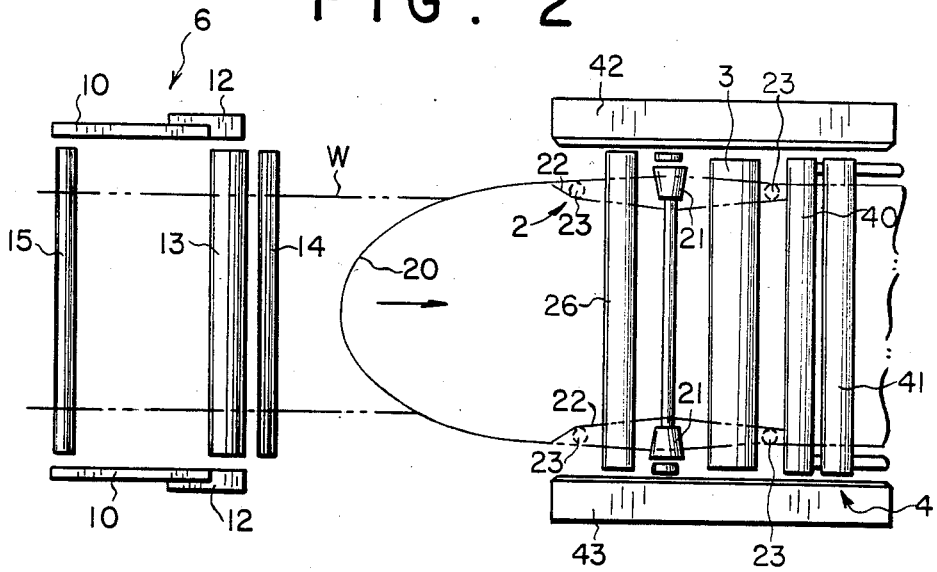
FIG. 2 is a plan view of the machine of FIG. 1.

Referring to FIG. 1, there is illustrated a finishing machine 1 constructed according to the invention for treating a web W of a tubular fabric, for example a knitted fabric produced on a circular knitting machine. The machine 1 includes, as shown in FIGS. 1 and 2, an edge drive means denoted generally 2, a treatment station 3 which may include a steaming means, a control means 4 for controlling cross-line configuration of the web W of tubular fabric and/or maintaining width of the fabric and a portion 5 of a batching station where the tubular fabric is folded or rolled for later use.

As shown in the figures, the web W extends over a conventional feed stand 6 where the stand comprises conventional frame members 10 and 12 including an intermittent feed roll 13 and an idler roll 14. The feed roll 13 serves to pull the web over an upper idler roll 15 contained on the top of frame member 10 from a supply truck 16.

The web W is pulled into the finishing machine 1 by means of the edge drive means 2 so as to pass over a spreader 20 which engages the inner sides of the tubular fabric to stretch the same into a flattened tube. The edge drive means 2, which is conventional and is of the type illustrated in U.S. Pat. No. 3,973,306, comprises tapered feed rolls 21 which engage the outer edges of the flattened tube of fabric and which, through the sides of the fabric, operatively engage idler wheels, not shown, over which endless belts 22 extend. Belts 22 in turn pass over idler rolls 23 to engage the inner flattened edges of the flattened tube of fabric and to provide a force on the tubular fabric to draw it over the spreader 20. Upper and lower control rolls 26 are provided for holding the spreader 20 and its associated interior drive means from being drawn into the fabric finishing machine 1 all as more fully described in the aforementioned U.S. Pat. No. 3,973,306.

Figure 4:
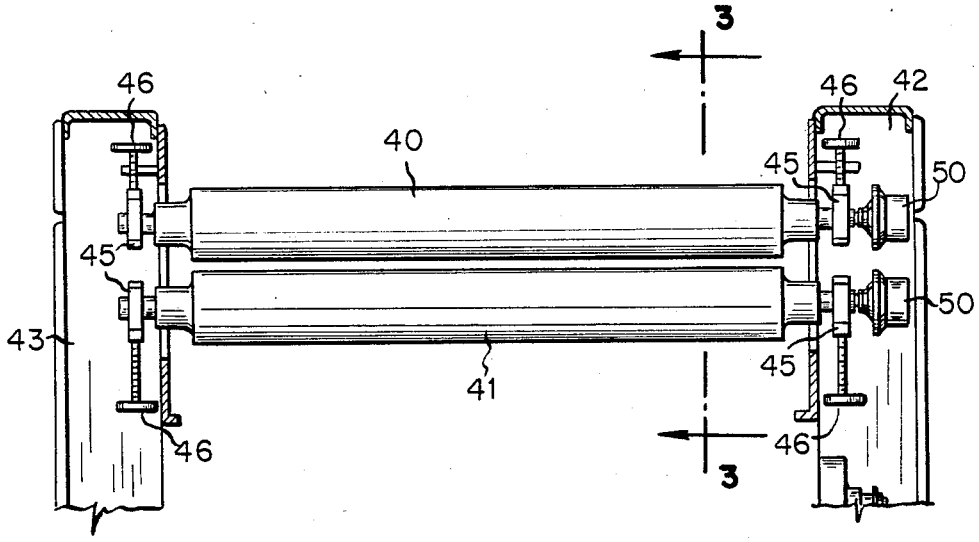

The control means 4 comprise control rolls 40 and 41 which are shown in FIG. 4 mounted inside machine side frame members 42 and 43 such that their axes of rotation lie in a common horizontal plane. The ends of the rolls 40 and 41 are journalled in bearings 45 and include adjustment means 46 by which the bearings 45 and consequently the rolls 40 and 41 may be moved towards and away from each other to vary the nip spacing therebetween.

The rolls themselves preferably are chrome-plated on their outer surface with the surface being roughened, as by sand blasting, in order to provide a gripping surface with the surface of the tubular fabric being treated.

Figure 3:
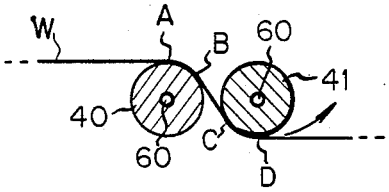
FIG. 3 is an enlarged sectional view of a portion of the figure of the machine of FIG. 1 taken along lines 3—3 of FIG. 4; and, FIG. 4 is an enlarged sectional plan view of a portion of FIG. 2.

Referring to FIG. 3, the web W coming from the treatment station 3 extends over roll 40 to engage and contact the roll along arc A-B from which it then passes to extend over and engage the roll 41 along the arc C-D and where the fabric extends to and leaves the rolls along tangents to the rolls. As seen in FIG. 3, the resulting engagement of the web of fabric W with rolls 40 and 41 is in the general shape of an S.

Rolls 40 and 41 are each in turn driven by variable control drive means 50 such that the peripheral speed of the rolls may be varied with that of the edge drive means 2. As a result lateral portions of the tubular fabric coming off the spreader may be bunched or tensioned with respect to edge portions of the tubular fabric engaged and driven by the edge drive means so as to control cross-line configuration of the fabric. Thus, for example, if the edges of the tube of fabric on the spreader advances ahead of the middle portions of the tube, drive means 50 may be speeded up relative to drive means 2 in order to exert a tension on the middle portions of the tube to straighten the middle portions with respect to the edge portions. Conversely, if the middle portions of the fabric extend ahead of the edge portions on the spreader, the drive means 50 may be slowed down relative to the drive means 2 in order to bunch the middle portion of the fabric with respect to the edge portions and thus maintain cross-line control.

The engagement of the fabric with the rolls and the friction between the web and the rolls is sufficient to substantially maintain the width of the web of fabric as it leaves the spreader and extends towards and over the control rolls provided that the peripheral speed of the rolls is the same as or greater than the speed of the edge drive means to insure no bunching of the fabric as it leaves the spreader.

Different types of fabric may have different coefficients of friction when engaging the rolls 40 and 41 thus effecting the retarding or pulling force exerted on the tubular fabric by the rolls. In order to assure that the proper retarding or pulling force is maintained between the surfaces of the rolls 40 and 41 with the web of fabric, the amount of arc or amount of engagement of the fabric with the rolls can be varied by moving the rolls towards or away from each other. Thus, if it is necessary to increase the pulling force on the web exerted by the rolls 40 and 41 or to increase the bunching effect, the rolls may be moved towards each other to increase the lengths of the arcs A-B and C-D engaged by the web of fabric. Conversely, if the forces are to be reduced, the length of arcs A-B and C-D engaged by the web may be reduced by moving rolls 40 and 41 away from each other.

It may be desirable when treating unnapped or smooth fabrics in which a sharp crease or flattened appearance would not be objectionable that the rolls 40 and 41 act as conventional calendar rolls. In this instance, the rolls would be moved towards each other to exert a pressure on both sides of the tubular fabric at the nip between the rolls.

Some fabrics may require further heat treatment after steaming to impart a finished appearance to the fabric. In such event, either of rolls 40 and 41 or both of the rolls may be heated, as for example, by passing a fluid heat carrier through ducts 60 contained within the rolls. Heating of the rolls further assures that steam from the spreader will not condense on the rolls to produce droplets causing objectionable wet spots. Heating of the rolls could also be accomplished by external heating means, as for example, radiant heating or by steam applied to the fabric in close proximity to the rolls.

The method of treating a tubular fabric by the machine as illustrated involves initially pulling an open end of a tubular fabric over the spreader 20 so that the endless drive belts 22 will engage the inner sides of the tube of fabric and so that the tapered rolls 21 will engage the outer edges of the tube. The open end of the tube is then passed through the treatment station 3 and threaded over and between the rolls 40 and 41 so that the fabric contacts a substantial arc of the periphery of both rolls and is then passed onto the portion 5 of a batching station.

The edge drive means 2 and drive means 50 are then started to draw tubular fabric over the spreader, through the treatment station and over the control rolls and onto the batching station with the peripheral speeds between the edge drive means and control rolls being varied to maintain a desired cross-line control of the fabric and/or maintain width of the fabric.

It is seen that the use of the particular arrangement of the control rolls provides a means for maintaining cross-line and/or width control of the fabric without subjecting the fabric to any pressing action which could result in a sharp crease or flattened appearance of the fabric.

We claim:

1. A fabric finishing machine for finishing a tubular fabric where said machine has a fabric spreader for spreading the tubular fabric into a flattened tube, edge drive means adapted to engage edges of a flattened tube to move the tube over the spreader and through said machine, a fabric treatment station for treating the fabric positioned downstream of said edge drive means in the direction of flow of fabric through the machine and a control means for maintaining and controlling the dimensional configuration of said flattened tube as it passes through said machine; characterized in that said control means comprises a pair of spaced apart opposed control rolls rotatably driven in opposite directions with said rolls being positioned downstream of said fabric treatment station with respect to the passage of fabric through said machine with said fabric extending over and contacting a substantial arc of the periphery of each control roll and with each roll being roughened and heated and in separate frictional driving engagement with the fabric and with the spacing between said rolls being greater than the thickness of said fabric, means for separately rotatably driving the control rolls by independent power source, and speed control means for varying the speed of rotation of the control rolls with respect to the speed of said edge drive means whereby when said machine is operated to provide control of cross-line configuration, lateral portions of said tubular fabric extending between said control rolls and said edge drive means may be positioned with respect to the edges of the fabric driven by said edge drive means to control cross-line configuration of said tubular fabric without imparting crease or flattened appearance to the fabric and whereby when said machine is operated to provide control of width, bunching of fabric leaving said spreader and extending to said control rolls may be prevented.

2. A fabric finishing machine according to claim 1 wherein said control rolls are positioned with their axes of rotation located in a horizontal plane and whereby said fabric contacts one roll along a tangent thereto to extend over an arc thereof to contact the second roll along a tangent thereto to extend over an arc thereof such that the fabric takes the general form of an S-shape passing over the rolls.

3. A fabric finishing machine according to claim 1 wherein said control rolls include a nip adjustment means whereby the spacing between said control rolls may be varied to regulate the nip spacing therebetween and to vary the length of arc of each roll over which the fabric extends to contact each roll. R

* * * * *